United States Patent [19]

Gallus

[11] 4,078,612

[45] Mar. 14, 1978

[54] WELL STIMULATING PROCESS

[75] Inventor: Julius P. Gallus, Anaheim, Calif.

[73] Assignee: Union Oil Company of California, Brea, Calif.

[21] Appl. No.: 749,735

[22] Filed: Dec. 13, 1976

[51] Int. Cl.[2] ..... E21B 43/00

[52] U.S. Cl. ..... 166/299; 102/21

[58] Field of Search ..... 166/299; 102/21

[56] References Cited

U.S. PATENT DOCUMENTS

| | | | |
|---|---|---|---|
| 3,630,279 | 12/1971 | Fast et al. | 166/299 |
| 3,630,281 | 12/1971 | Fast et al. | 166/299 |
| 3,727,690 | 4/1973 | Munson | 166/299 |
| 3,771,600 | 11/1973 | Hill | 166/299 |
| 3,822,916 | 7/1974 | Jacoby | 166/299 |

*Primary Examiner*—James A. Leppink

*Attorney, Agent, or Firm*—Richard C. Hartman; Dean Sandford

[57] ABSTRACT

A method for stimulating a producing well by introducing an explosive into perforation tunnels which communicate between the reservoir and the well bore and detonating the explosive while maintaining the well bore at about reservoir pressure and relatively free of explosive.

18 Claims, 4 Drawing Figures

WELL STIMULATING PROCESS

BACKGROUND OF THE INVENTION

This invention relates to the recovery of fluids from subterranean formations penetrated by a well and more particularly to a process for stimulating the well and improving the production of fluids therefrom.

In the production of fluids, such as petroleum, from subterranean reservoirs by penetrating the reservoir with a well, the permeability of the formation adjacent the well bore is critical to the productivity of the well. In completing a well, particularly one from which petroleum is to be recovered, it is conventional to create a series of passages, referred to herein as perforation tunnels, which extend from the well bore into the formation so as to provide channels for directing the flow of fluids from the formation into the well bore. In a typical case the productivity of a well over a given period of time will drop off as a result of the decrease in permeability of the reservoir adjacent the well bore. Typically this can be accounted for by the accumulation in the formation pores of various materials, such as waxes, insoluble inorganic material, residue from drilling fluids and the like. In addition, productivity of the well is also reduced by the accumulation of these permeability reducing materials in the so-called "crushed zone" which surrounds the perforation tunnels. The "crushed zone" consists of compacted detritus produced during the formation of the tunnels.

Various methods are known in the art for stimulating the productivity of fluid producing wells by improving the permeability of the formation adjacent the well bore. For example, "acidizing" processes are utilized wherein an acid solution is injected into the well and caused to enter the pores of the formation to dissolve the acid soluble portion of the formation rock and permeability reducing materials accumulated in the formation pores adjacent the well thereby to enlarge and reopen the pores in the formation. Acidizing, however, has several disadvantages not the least of which is that it cannot be used where the formation is not susceptible to attack by acid. Also, unless inhibited, acid solutions are extremely corrosive to pumps, lines and the like and thus increase the cost of maintenance of the well. In addition, unless carefully controlled, acidizing can result in the extension of the well bore into undesirable levels of the formation by acid erosion, i.e. the extension of a petroleum producing well into the water zones.

Other means for stimulating a producing well include the injection of a solvent, hot solvent or steam into the well to dissolve or melt paraffin deposits, thus reopening the perforation tunnels and pores of the formation adjacent the well bore. However, solvent and steam techniques are effective only in those cases where loss of permeability is caused by the deposition of paraffins and waxes from crude petroleum and is not effective where loss of production is caused by inorganic deposits in the pores of the formation or drilling fluid deposits. Another alternative is to rework the well by plugging the existing perforation tunnels and forming new perforation tunnels or by fracturing the well by explosives or by hydraulic processes. These methods are time consuming and expensive and in the case of explosive fracturing it is necessary to replace a substantial portion of the well casing and the reinforcing cement work resulting in lost production time and substantial cost.

SUMMARY OF THE INVENTION

Accordingly, it is an object of the present invention to provide a method for the stimulation of fluid-producing wells.

Another object of the present invention is to provide a method for the stimulation of fluid-producing wells by the use of explosive materials.

Another object of the invention is to provide a process using explosive materials for stimulating a fluid production well while maintaining damage to the well itself at a minimum.

Yet another object of the present invention is to provide a means for the stimulation of production in a fluids producing well by cleaning the porosity reducing material from the existing perforation tunnels communicating between the well bore and the reservoir.

Other objects of the invention will be apparent to those skilled in the art from the following description of the invention and the accompanying drawings.

Briefly, the present invention resides in a process for cleaning the perforation tunnels that communicate between a fluids producing well bore and a subterranean fluid containing formation thereby to stimulate the production of fluids from the well. More particularly the process of the present invention involves the introduction of explodable material in free-flowing form into the well at sufficient pressure to overcome the reservoir pressure and to urge a major portion of the explodable material into the existing perforation tunnels. The explodable material is collected in the perforation tunnels and the well is then brought to a treatment pressure of less than the fracturing pressure of the formation and greater than the reservoir pressure. The explodable material is then detonated while the well bore is maintained at the treatment pressure so that the force of the explosion generates a higher pressure in the tunnel than the treatment pressure in the well bore. The pressure differential results in explusion of the gases and tunnel detritus generated by the explosion out of the perforation tunnels and into the well bore. In this manner the inner walls of the perforation tunnels are substantially cleaned of compacted and deposited materials thus enhancing the flow of fluids from the reservoir into the perforation tunnels. Also, obstructing material in the tunnels is removed so that the flow of fluids into the well is not restricted and the productivity of the well is stimulated.

In a preferred embodiment of the invention the explodable material is in the form of a free-flowing dispersion of solid particles of explodable material in a fluid vehicle inert to the explodable material. As the dispersion is forced through a perforation tunnel, the fluid vehicle is dispersed through the tunnel walls and the particles of explodable material are deposited in the tunnel for subsequent detonation. The well bore is flushed to remove excess explodable material to avoid any appreciable explosion in the well bore thus reducing well bore damage by explosion to a minimum.

Commercially available explosives are utilized in forming the free-flowing explodable material for use in the present invention and techniques already practiced in the art can be employed for detonating the explodable material in the perforation tunnels. Other features of the present invention reside in its relative safety, its simplicity and its minimal adverse effect on the well. Other advantages and features of the present invention will be apparent from the following detailed description taken in conjunction with the drawings.

DESCRIPTION OF A PREFERRED EMBODIMENT OF THE INVENTION

As used herein the term "fracturing pressure" is used to designate the fluid pressure required for a given formation to counterbalance the weight of the overlying formation plus an additional pressure increment to actually crack the formation. The term "reservoir pressure" designates the pressure at the face of a productive formation when the well is shut in plus the weight of the column of fluid in the well bore. "Bottom hole" pressure is the pressure at the bottom of the well and can be measured under flowing conditions or with the well shut in. "Treatment Pressure" is used to designate the bottom hole pressure at which the well is maintained after the explodable material is positioned. Treatment pressure can range between the fracturing pressure and the reservoir pressure, and preferably is equal to or just slightly greater than the reservoir pressure.

Figure 1:
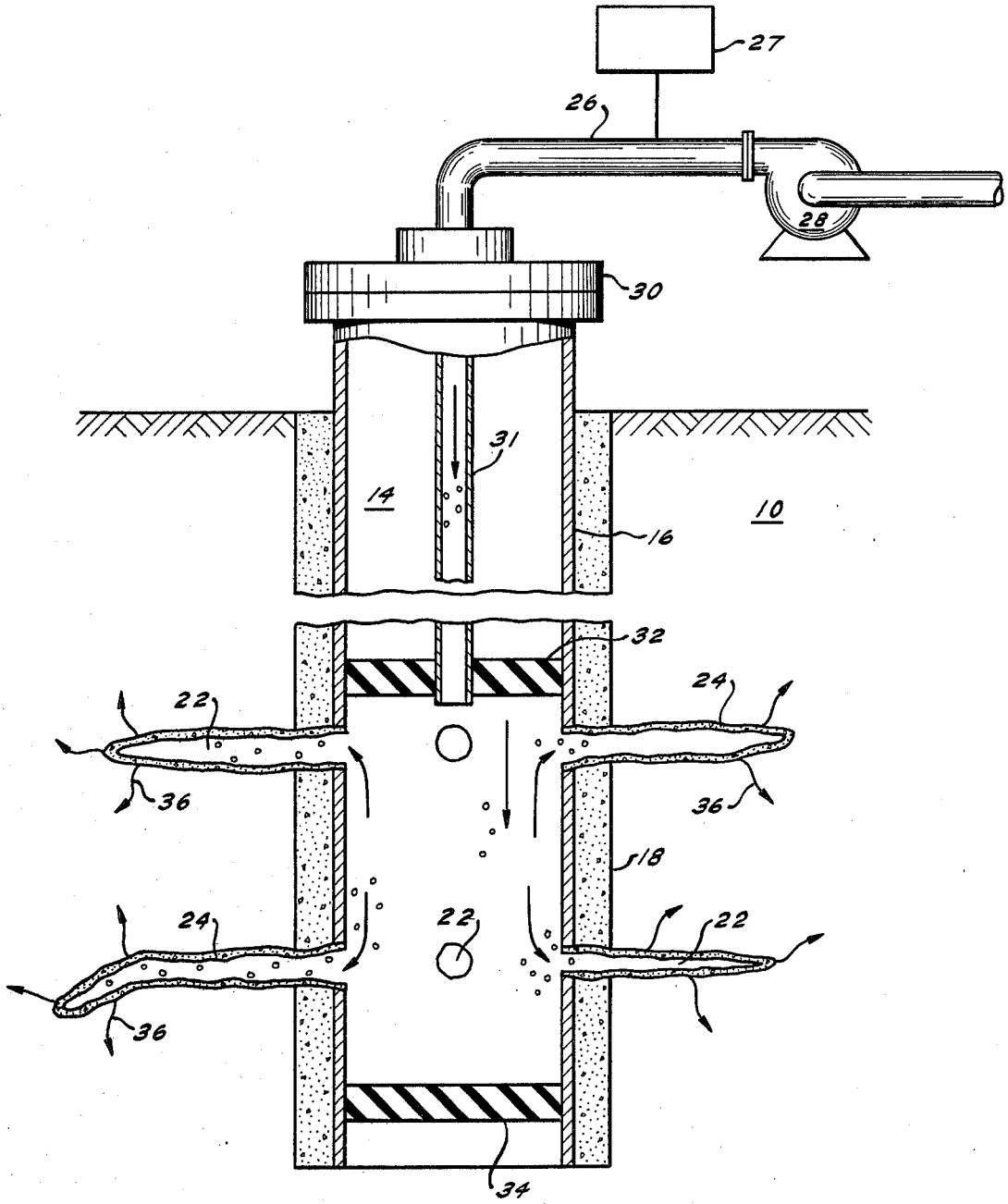
FIG. 1 is a schematic sectional view of a well bore showing the introduction of explodable material into the perforation tunnels.
Figure 2:
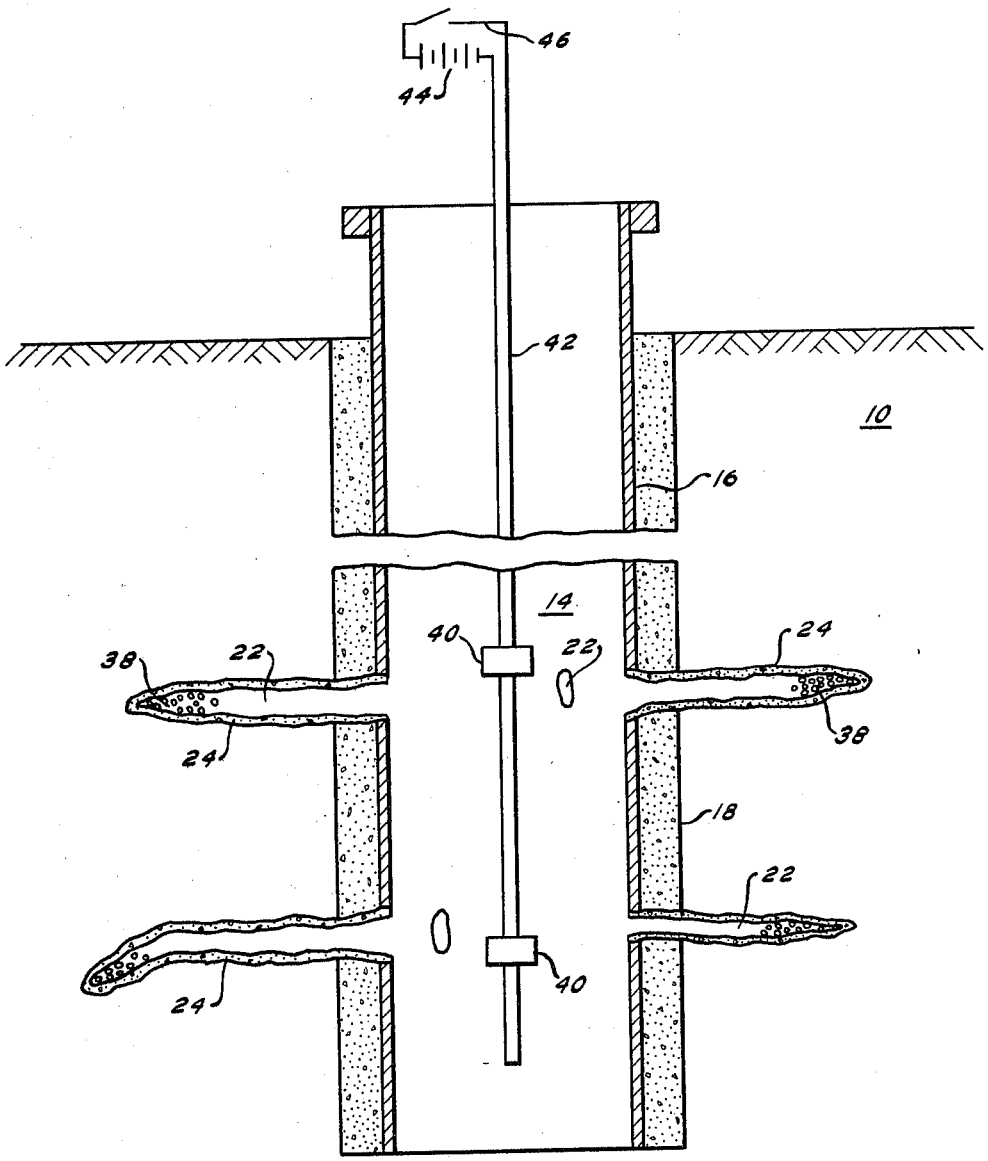
FIG. 2 is a sectional view of the well bore of FIG. 1 showing the explodable material in place in the perforation tunnels and illustrating means for detonating the explodable material.

Referring now to the drawings, and more particularly to FIGS. 1 and 2, a subterranean reservoir 10 containing a recoverable fluid, such as petroleum, gas, steam, hot water, hot brine or the like, is penetrated by a well bore 14 that extends from the surface into the fluid-bearing portion of the reservoir. Normally at least one string of production casing 16 reinforced with concrete 18 extends from the surface to the top of and sometimes through the producing zone of the well to protect the well bore 14 from unwanted fluids and loose earth and to prevent communication between zones. Fluids are collected in the well bore 14 through perforation tunnels 22 which open into the well bore 14 and provide communication between the reservoir 10 and the well bore. Typically the perforation tunnels 22 are formed after the casing 16 and the cement 18 are in place in the well by perforating the casing and the cement with a gun which fires either a projectile or, more preferably, a shaped charge through the casing wall at the desired location. The perforation tunnels 22 are prepared in that section of the well extending through the fluid-bearing portion of the reservoir 10 and typically the tunnels will range from about 0.2 inches to about 1 inch in diameter at the point where they open into the wellbore 14 and, depending upon the nature of the reservoir formation and method employed to perforate the well bore, will typically extend from about 3 inches to about 12 inches into the reservoir formation.

During the preparation of the perforation tunnels 22 a substantial portion of the detritus produced during the perforation operation is compressed and remains along the inner walls of the perforation tunnels 22. This area of crushed and compressed material is referred to as the "crushed zone." The crushed zone can be compressed to the point where the permeability is less than that of the adjacent fluid-bearing formation 10 and thus can inhibit or restrict the flow of fluids from the formation into the perforation tunnel 22 and ultimately into the well bore 14. In addition, deposits of scale, waxes and the like from the reservoir fluids will build up in and along walls of the perforation tunnels 22 further reducing the permeability of the formation adjacent the tunnels. These deposits and the crushed zone are shown schematically as a low permeability zone 24. The deposits and the crushed zone alone or together when accumulated in the low permeability zone 24 can ultimately restrict or even in a severe case completely block the flow of fluids from the reservoir 10 through the perforation tunnel 22 into the well bore 14. Any restriction of the flow of fluids from the reservoir 10 into the well bore 14 results in impairment of the productivity of the well.

In accordance with the present invention a method is provided for cleaning the perforation tunnels 22 by introducing an explodable material into the perforation tunnels 22 and detonating it therein while the well bore is maintained at treatment pressure so as to create in the perforation tunnels a higher pressure than in the well bore. As a result of the pressure differential, shock waves and gases generated by the explosion travel through the perforation tunnel 22 into the well bore removing all or a substantial portion of the low permeability zone 24 of the perforation tunnels 22 resulting in the enhancement of the productivity of the well.

The choice of the particular explodable material utilized in the process is not critical and any of several well-known explosive compositions or mixtures of compositions are utilized in the process. The explodable material is preferably utilized as a free flowing dispersion or slurry of particles, either solid or liquid, of an explosive composition in a suitable fluid vehicle in which the particles are insoluble or immiscible and which is substantially inert with respect to the explosive composition carried thereby. Preferably the fluid vehicle is of sufficiently low viscosity as to be readily percolated through the low permeability zone 24 of the perforation tunnels 22 while the particles of explodable material are retained in the perforation tunnels.

Suitable explodable materials for use in the process include, for example, nitroglycerin, trinitrotoluene, nitromethane, pentaerythritol tetranitrate and the like. Also, hypergolic mixtures, for example fuming nitric acid and furfuryl alcohol, ammonium nitrate and hydrazine, perhalo acids and hydrocarbons and the like, can also be employed with one member of the combination comprising the explodable material which is placed in the perforation tunnels and the second component acting as the detonator by contacting the first member to form the hypergolic mixture.

As mentioned, the particles of explodable material may be solid or liquid and may be suspended directly in a liquid vehicle in which they are immiscible. Preferably, and in accordance with conventional technique, the particles may be first encapsulated with a suitable encapsulating material such as natural grums, i.e. gelatin, gum arabic, gum tragacanth or synthetic material, i.e. polyvinly alcohols, carboxylated methylcelluloses and the encapsulated particles slurried in a liquid vehicle. Encapsulation is of particular interest in connection with the hypergolic mixtures where a first component of the mixture is encapsulated by an encapsulating material which is dissolved by the second component itself or a liquid in which the second component is dispersed. Encapsulation is also preferred with any explodable material because it prevents agglomeration or particle growth and permits the use of an explosive composition with liquid vehicles to which the explosive composition may be sensitive. Also the encapsulated particles are protected to some degree from accidental shock and from the oftentimes severe conditions which may exist in a well.

The choice of the fluid vehicle is not critical and includes liquids such as petroleum, diesel fuel, water, brine, alcohols, aqueous acid solutions and the like. Aqueous hydrochloric acid solutions are of particular interest in view of the fact that the acid solution not only provides the vehicle for the particles of explodable material but also will provide an acidizing treatment to the well which can be effective in initially treating the perforation tunnels 22 so as to improve the flow of the free-flowing explodable material into the perforation tunnel in the manner to be more fully explained hereinafter. In addition the explodable material can be entrained in a gas such as nitrogen or compressed air and propelled directly into the perforation tunnels 22.

The precise composition and the manner of preparation of slurries of explodable material are well-known in the art. The choice of particle size range of the explodable material in the dispersion is largely dependent upon the diameter of the perforation tunnel 22. It is preferred that the particle size of explodable material be sufficiently small so that the particles of explodable material can enter the perforation tunnel 22 even when the diameter thereof is substantially reduced by deposited material. Consequently, it is preferred that the particle size be less than about one-half inch and a preferred range is between about ⅛ of an inch to about 50 mesh (about 0.01 inch).

As is most clearly shown in FIG. 1, the explodable material is introduced into the well bore 14 through a line 26 from a suitable container 27. A pump 28 is disposed in the line 26 for pumping a fluid vehicle through the line from a source, not shown. The line 26 is provided with a fluid-tight wellhead connection 30 and communicates with a line 31 which extends into the well bore 14 and terminates with its lower end adjacent the perforation tunnels 22 in the producing portion of the well. That portion of the well bore 14 which is to be treated in accordance with the process is preferably defined by upper and lower packing elements 32 and 34 respectively. Although good results are obtained when the well is cleaned in accordance with the invention without the use of packing elements, the packing elements aid in controlling the placement of the explodable material.

The packing elements 32 and 34 may be of any well-known type, expandable mechanically or by applied hydraulic pressure, to seal off that portion of the well bore 14 containing the perforation tunnel 22 to be treated in accordance with the present invention. The location of the packing elements 32 and 34 with respect to the perforation tunnels 22 in the well bore 14 is determined from well-known logging methods and techniques. It should also be noted that only a single upper packing element need be employed in spaced relationship to the bottom of the well to seal off the area of the well being treated.

The dispersion or suspension of explodable material is introduced into the confined space between the upper and lower packing elements, 32 and 34 respectively, at sufficient pressure to maintain the suspension and to force at least a substantial portion of the suspension into the perforation tunnels 22. The pressure at which the explodable material is introduced is in excess of the reservoir pressure and can approach the fracturing pressure depending upon the nature and sensitivity of the explodable material. The fluid vehicle typically passes into the reservoir, as indicated by the arrows 36, while particles of the explodable material are screened out and accumulated in the perforation tunnel 22. As is more clearly shown in FIG. 2, after the dispersion has been injected, the explodable material is accumulated in the perforation tunnels 22 as a mass 38 of particles. The tube 26 and the upper and lower packing elements 32 and 34 are withdrawn from the well and the well allowed to come to a treatment pressure. Treatment pressure is readily adjusted by raising or lowering the fluid level or fluid density in the well bore 14 and preferably the treatment pressure is just in excess of reservoir pressure.

The amount of explodable material used for any given treatment will depend upon factors such as the explosive composition used, the nature of the well, the character of the formation to be fractured, and the number of perforation tunnels included within the portion of the well bore 14 being treated. It is preferred to introduce an excess of the particles of explosive material based on the total volume of the perforation tunnels 22 being treated. However, it is undesirable to maintain any substantial amount of explodable material in the well bore 14 to avoid a damaging explosion in the well bore itself and to insure that during the explosion step, there is a higher pressure in the perforation tunnels than in the well bore. To insure that the well bore 14 is substantially free of explodable material, it is preferred practice to clear the well bore after the dispersion has been introduced. Accordingly it is preferred practice to flush the well bore 14 with water, brine or other non-explosive fluid for the purpose of removing particles of explodable material which may have accumulated in the well bore.

Detonation of the mass 38 can be accomplished by any of several methods. FIG. 2 illustrates one such method wherein the mass 38 is detonated by shock generated by a detonating string comprising a plurality of electrically fired detonators 40 disposed on insulated electric cables 42 which are connected to a source of electrical current 44 through a switch 46. On closing the the switch 46 the circuit is completed and the detonators 40 are fired thereby producing a shock wave resulting in the detonation of the mass 38 of explodable material in the perforation tunnels 22. The detonators 40 are preferably disposed along the cables 42 so as to be positioned in the well bore 14 in general alignment with the openings of the perforation tunnels 22.

Figure 3:
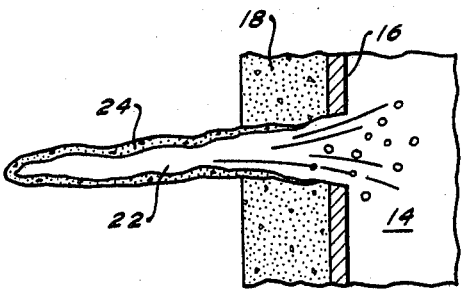
FIG. 3 is an enlarged sectional view of a portion of the fluids-producing well of FIG. 1 illustrating a perforation tunnel during the explosion phase of the process.
Figure 4:
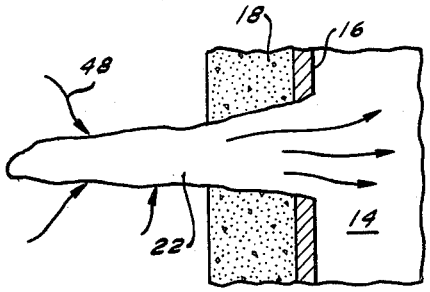
FIG. 4 is an enlarged sectional view similar to FIG. 3 showing a perforation tunnel after the explosion phase of the process.

Explosion of the mass 38 in the perforation tunnels 22 produces substantial pressure in the tunnels. The pressure in the tunnels 22 during explosion exceeds the treatment pressure in the well bore 14. The uneven pressure causes the gases generated by the explosion in the perforation tunnels 22 to move through the perforation tunnels into the well bore (FIG. 3). The pressure generated by the gas of the explosion and its movement toward the well bore produces a scouring of the walls and results in the removal of a substantial portion of the material forming the low permeability zone 24 of the perforation tunnels 22. This material is carried along with the gases of the explosion into the well bore 14 leaving the walls of the perforation tunnel scoured and more permeable (FIG. 4). The flow of reservoir fluids, represented by arrows 48, is substantially improved and well productivity is enhanced.

While the invention has been described in connection with the use of a string of electrically fired charges to detonate the explodable material in the perforation tunnels, it should be clear that other detonating means may be employed. For example when using hypergolic mixtures, the first component, preferably the fuel component, of the hypergolic mixture is placed in the perforation tunnels in the manner already described. Following this placement, the second component, preferably the oxidizer, is injected into the confined space between the upper and lower packing elements 32 and 34 and it is also forced into the perforation tunnels and into contact with the fuel component. Combustion of the fuel element is then allowed to proceed with the well bore 14 being maintained at treatment pressure. The pressures generated in the perforation tunnels 22 by the combustion exceed the treatment pressure and the combustion gases are expelled from the tunnels producing the desired scouring action.

It should also be clear that the process may be repeated one or more times in order to insure that the perforation tunnels 22 are cleaned out. In some instances obstructions are built up in the perforation tunnels which prohibit the explodable material from completely penetrating the perforation tunnel. Likewise under certain circumstances the perforation tunnel may be almost completely closed by material deposited therein. In such cases only a small amount of explodable material will accumulate in the perforation tunnel and upon detonation will only partially clean the tunnel. When repeating the process in such a case, it may be desirable to temporarily close off the already cleaned perforation tunnels 22 using techniques and materials known in the art so as to prevent the explodable material from entering these tunnels in preference to the blocked or partially blocked tunnel.

In those cases where the producing zone of the well is particularly thick, it may be desired to employ the present process to only a portion of the producing zone to reduce the amount of explodable material pumped into the well at any given time and to insure reliability of the detonation of the explodable material in the perforation tunnels 22. When cleaning the well in this manner the upper and lower packing elements 32 and 34 can be relocated after the explosion step so that the entire thickness of the producing zone is eventually traversed and the perforation tunnels cleaned in the manner described. It is not essential that the detritus from the perforation tunnels be removed from the well bore after each cleaning operation since this will be a relatively insignificant amount of loose material and will not affect well productivity if allowed to settle to the bottom of the well bore.

From the foregoing description it should be clear to one skilled in the art how the objects and advantages of the present invention are achieved. While the invention has been described in connection with certain preferred embodiments thereof, further modifications will be apparent to those skilled in the art. Such modifications are included within the scope of this invention as defined by the following claims.

I claim:

1. A method for stimulating and enhancing the productivity of a fluids-producing well, said well penetrating the fluid-bearing portion of a reservoir and being provided with a plurality of relatively short perforation tunnels communicating between the formation and the well bore, the walls of said perforation tunnels having a low permeability zone of compacted detritus, said method comprising:

introducing a flowable, explodable material comprising particles of an explosive composition dispersed in a fluid vehicle through said well and into at least one of said perforation tunnels;

removing substantially all of said explodable material remaining in said well bore;

maintaining the bore of said well at a treatment pressure of between the fracturing pressure of said reservoir and the reservoir pressure; and detonating said explodable material in said perforation tunnel thereby generating a fluid pressure in said perforation tunnel exceeding the treatment pressure in said well bore;

whereby a substantial portion of said low permeability zone is scoured out of said perforation tunnel and into the well bore, and the flow of fluids from said formation is enhanced.

2. The method of claim 1 wherein said explodable material is introduced into said perforation tunnel by the consecutive steps of introducing said explodable material into said well bore at a pressure in excess of the reservoir pressure; and displacing a substantial portion of said explodable material from said well bore into at least one of said perforation tunnels.

3. The method of claim 1 wherein said explodable material comprises a slurry of particles of a solid explosive composition dispersed in a liquid vehicle.

4. The method of claim 1 wherein said fluid vehicle percolates through the walls of the perforation tunnel and said particles of explosive material accumulate within the perforation tunnel.

5. The method of claim 1 further including the step of positioning at least one packing element in spaced relation to the bottom of the well, said packing element being positioned prior to introducing said explodable material into the perforation tunnel.

6. The method of claim 5 wherein a spaced apart pair of packing elements are positioned in the well bore, said packing elements defining therebetween a confined portion of the well bore and thereafter introducing said free flowing explodable material into said confined area.

7. The method of claim 5 further including the step of removing said packing element prior to detonating said explodable material.

8. The method of claim 6 further including the step of removing at least the upper of said pair of spaced apart packing elements prior to detonating said explodable material.

9. A process for treating a petroleum or gas-producing well to enhance the productivity thereof, said well having a plurality of relatively short perforation tunnels in communication with said reservoir and the well bore, the walls of said tunnels having a low permeability zone of compacted detritus, said process comprising the steps of:

introducing a slurry comprised of particles of an explodable material in a liquid vehicle through said well and into at least one of said perforation tunnels at a pressure exceeding the reservoir pressure, whereby said liquid vehicle percolates through the walls of the tunnel and a mass of said particles accumulates within the tunnel;

removing substantially all of said explodable material remaining in the well bore;

thereafter bringing said well to a bottom hole pressure of not more than the fracturing pressure of said reservoir and not less than the reservoir pressure; and detonating said explodable material while maintaining said bottom hole pressure in said well, thereby generating a fluid pressure in said perforation tunnel exceeding said bottom hole pressure in said well;

whereby a substantial portion of said low permeability zone is scoured out of said perforation tunnel and into the well bore, and the flow of fluids from said formation is enhanced.

10. The process of claim 9 wherein said particles are removed from the well bore by flushing the well bore after the introduction of said explodable material into said perforation tunnel.

11. The process of claim 9 wherein said well is maintained at a bottom hole pressure of about reservoir pressure prior to detonating said explodable material.

12. A method for cleaning a perforation tunnel communicating between a well bore and a subterranean formation, the walls of said perforation tunnel having a low permeability zone of compacted detritus, said method comprising:

introducing a flowable, explodable material comprising particles of an explosive composition dispersed in a fluid vehicle through said well bore and into said perforation tunnel, whereby said fluid vehicle percolates through the walls of said perforation tunnel and a mass of said particles accumulates in said perforation tunnel;

removing substantially all of said explodable material remaining in said well bore;

maintaining the bore of said well at a treatment pressure of between the fracture pressure of said reservoir and the reservoir pressure; and detonating said explodable material in said perforation tunnel thereby generating a fluid pressure in said perforation tunnel exceeding the treatment pressure in the well bore;

whereby a substantial portion of said low permeability zone is scoured out of said perforation tunnel and into the well bore and the flow of fluids between the formation and the well bore is enhanced.

13. The method defined in claim 12 wherein said particles are solid particles and said fluid vehicle is a liquid vehicle.

14. The method of claim 12 wherein said flowable explodable material is introduced into said perforation tunnel by the consecutive steps of: positioning a spaced apart pair of packing elements in said well bore, said packing elements defining therebetween a confined area in fluid communication with said perforation tunnel; introducing said flowable, explodable material into said confined area; and displacing said flowable explodable material from said confined area into said perforation tunnel.

15. A method for cleaning perforation tunnels communicating between a well bore and a fluid-bearing portion of a reservoir, the walls of said perforation tunnels having a low permeability zone of compacted detritus, said method comprising:

introducing a small amount of a flowable, explodable material comprised of particles of a solid explosive composition dispersed in a liquid vehicle into said well at a pressure above the reservoir pressure, said particles having a particle size of between about 0.01 inch and $\frac{1}{8}$ inch, said small amount of said explodable material being a slight excess of the amount required to fill the volume of said tunnels with said particles;

displacing a substantial portion of said explodable material into said perforation tunnels, whereby said liquid vehicle percolates through the walls of said perforation tunnels and a mass of said particles accumulates within said perforation tunnels;

removing substantially all of said explodable material which remains in said well bore;

thereafter bringing said well to a bottom hole pressure of just greater than the reservoir pressure; and detonating said explodable material in said perforation tunnels thereby generating a fluid pressure in said perforation tunnels which exceeds said bottom hole pressure;

whereby a substantial portion of said low permeability zone is scoured out of said perforation tunnels and into said well bore, and the flow of fluid between said formation and said well bore is enhanced.

16. The method of claim 15 further including the step of positioning at least one packing element in spaced relationship to the bottom of the well, said packing element being positioned prior to introducing said explodable material into said well.

17. The method of claim 16 wherein a spaced apart pair of packing elements is positioned in the well bore, said packing elements defining therebetween a confined portion of the well bore which is in fluid communication with at least one of said perforation tunnels, and wherein said explodable material is introduced only into said confined area of said well bore and thereafter is displaced therefrom and into said perforation tunnel.

18. The method of claim 17 further including the step of removing at least the upper packing element of said pair after displacement of the explodable material and before detonation thereof.

* * * * *